US005132678A

United States Patent [19]

Morris

[11] Patent Number: 5,132,678

[45] Date of Patent: Jul. 21, 1992

[54] DISPLAY DEVICE WITH TIME-MULTIPLEXED ADDRESSING OF GROUPS OF ROWS OF PIXELS

[75] Inventor: Christopher J. Morris, Feltham, England

[73] Assignee: Thorn EMI plc, London, England

[21] Appl. No.: 789,811

[22] Filed: Nov. 12, 1991

Related U.S. Application Data

[63] Continuation of Ser. No. 670,521, Mar. 18, 1991, abandoned, which is a continuation of Ser. No. 278,511, Dec. 1, 1988, abandoned.

[30] Foreign Application Priority Data

Dec. 4, 1987 [GB] United Kingdom ..... 8728435

[51] Int. Cl.[5] ..... G09G 3/00

[52] U.S. Cl. ..... 340/800; 340/804

[58] Field of Search ..... 340/765, 784, 708, 800, 340/802, 803, 804, 811, 768; 377/70, 77

[56] References Cited

U.S. PATENT DOCUMENTS

| | | | |
|---|---|---|---|
| 3,949,391 | 4/1976 | Benjamin | 340/708 |
| 4,277,783 | 7/1981 | Sampieri et al. | 340/708 |
| 4,691,200 | 9/1987 | Stephany | 340/803 |
| 4,845,473 | 7/1989 | Matsuhashi et al. | 340/784 |

*Primary Examiner*—Jeffery A. Brier

*Attorney, Agent, or Firm*—Fleit, Jacobson, Cohn, Price, Holman & Stern

[57] ABSTRACT

A method of operating a display comprising a lattice of pixel elements, includes the step of time-multiplex addressing collections of pixel elements. This addressing step includes using a first shift register means to designate operation of a second shift register means to select a function to be performed. If the second shift register means is in bypass mode, then the first shift register means is effective as a mask to specify which of the stages in the second register means should be bypassed, and allows non-sequential group addressing of the pixel elements. Such an arrangement of first and second shift register means is suitable for use in controlling the addressing of collections or rows of pixel elements; the function to be selected by the second shift register means is the strobing of the collections or rows.

7 Claims, 4 Drawing Sheets

| | $t_1$ | $t_5$ | $t_1$ | $t_2$ | $t_3$ | $t_4$ | $t_5$ | $t_6$ | $t_7$ | $t_8$ |
|---|---|---|---|---|---|---|---|---|---|---|
| 1 | 1 | 0 | 1 | | | | | | | |
| 2 | 1 | 1 | | 1 | | | 1 | | | |
| 3 | 0 | 1 | | | | | | 1 | | |
| 4 | 1 | 0 | | | 1 | | | | | |
| 5 | 0 | 1 | | | | | | | 1 | |
| 6 | 0 | 0 | | | | | | | | |
| 7 | 0 | 0 | | | | | | | | |
| 8 | 1 | 0 | | | | 1 | | | | |
| 9 | 0 | 1 | | | | | | | | 1 |
| 10 | 0 | 0 | | | | | | | | |
| 11 | 0 | 0 | | | | | | | | |
| 12 | 0 | 0 | | | | | | | | |
| 13 | 0 | 0 | | | | | | | | |
| 14 | 0 | 0 | | | | | | | | |
| 15 | 0 | 0 | | | | | | | | |
| 16 | 0 | 0 | | | | | | | | |

DISPLAY DEVICE WITH TIME-MULTIPLEXED ADDRESSING OF GROUPS OF ROWS OF PIXELS

This application is a continuation of application Ser. No. 07/670,521, filed Mar. 18, 1991 now abandoned, which is a continuation of application Ser. No. 07/278,511, filed Dec. 1, 1988 now abandoned.

The present invention relates to a display device and especially but not solely to a liquid crystal display device.

Row drivers on sequentially-addressed displays can be implemented using a simple shift register to control the outputs. The register can be loaded with all zeros and a single one such that each time the register is clocked a new row is stimulated (i.e. strobed). This can be combined with a drive circuit to apply a complex strobe waveform to each row of the display in turn. A suitable drive circuit, e.g. as disclosed in our copending European Patent Application No. 88306637.5, for use with the simple shift register comprises means to generate a first waveform A at a first supply rail, means to generate a second waveform at a second supply rail and a display driver chip with a plurality of outputs. Each output includes a switch for switching the output either to waveform A at the first supply rail or to waveform B at the second supply rail. The selective switching of each output to either waveform A or to waveform B is controlled by control and output latch data from a control circuit, the order of switching determining whether or not the complex waveform produced is a strobe waveform. The outputs of the simple shift register determine whether or not the order of switching is to produce the strobe waveform—a '1' selects the strobe waveform and a '0' selects the non-strobe waveform.

This arrangement does not, however, supply an easy solution to non-sequential addressing schemes, e.g. as disclosed in our copending published European Patent Application No. 0261901A, as the step between each row to be strobed varies from one line to half the display. Thus, either each individual row driver has to be loaded up with data independently, once for each row address period, or large numbers of clock pulses need to be applied to the row drivers between row address periods. These solutions require either high speed clock signals or large numbers of data signals. Both of these are undesirable if the chips are to be mounted on the glass substrate.

It is an object of the present invention to provide a method of operating a display device which at least alleviates the problem outlined hereinbefore.

According to a first aspect of the present invention there is provided a method of operating a display comprising a lattice of pixel elements, the method comprising time-multiplex addressing collections of pixel elements wherein the addressing step includes using a first shift register means to designate operation of a second shift register means to select a function to be performed.

According to a second aspect of the present invention there is provided a display device comprising a lattice of pixel elements and means for effecting time-multiplex addressing collections of pixel elements, the addressing means including a first shift register means to designate operation of a second shift register means to select a function to be performed.

The present invention is applicable to colour displays and to monochrome displays.

Another aspect of the present invention provides equipment suited and/or designed for the generation of signals of a format for a display device embodying the present invention, for example of a format as described and shown herein. Further aspects of the present invention provide equipment suited and/or designed for the transmission of such signals, equipment suited and/or designed for the reception of such signals, and equipment for the processing of such signals. Thus, for example, the present invention embodies a driver integrated circuit which is suited and/or designed for the addressing of a display device in the manner herein described.

In order that the invention may more readily be understood, a description is now given, by way of example only, reference being made to the accompanying drawings, in which.

Figure 5:
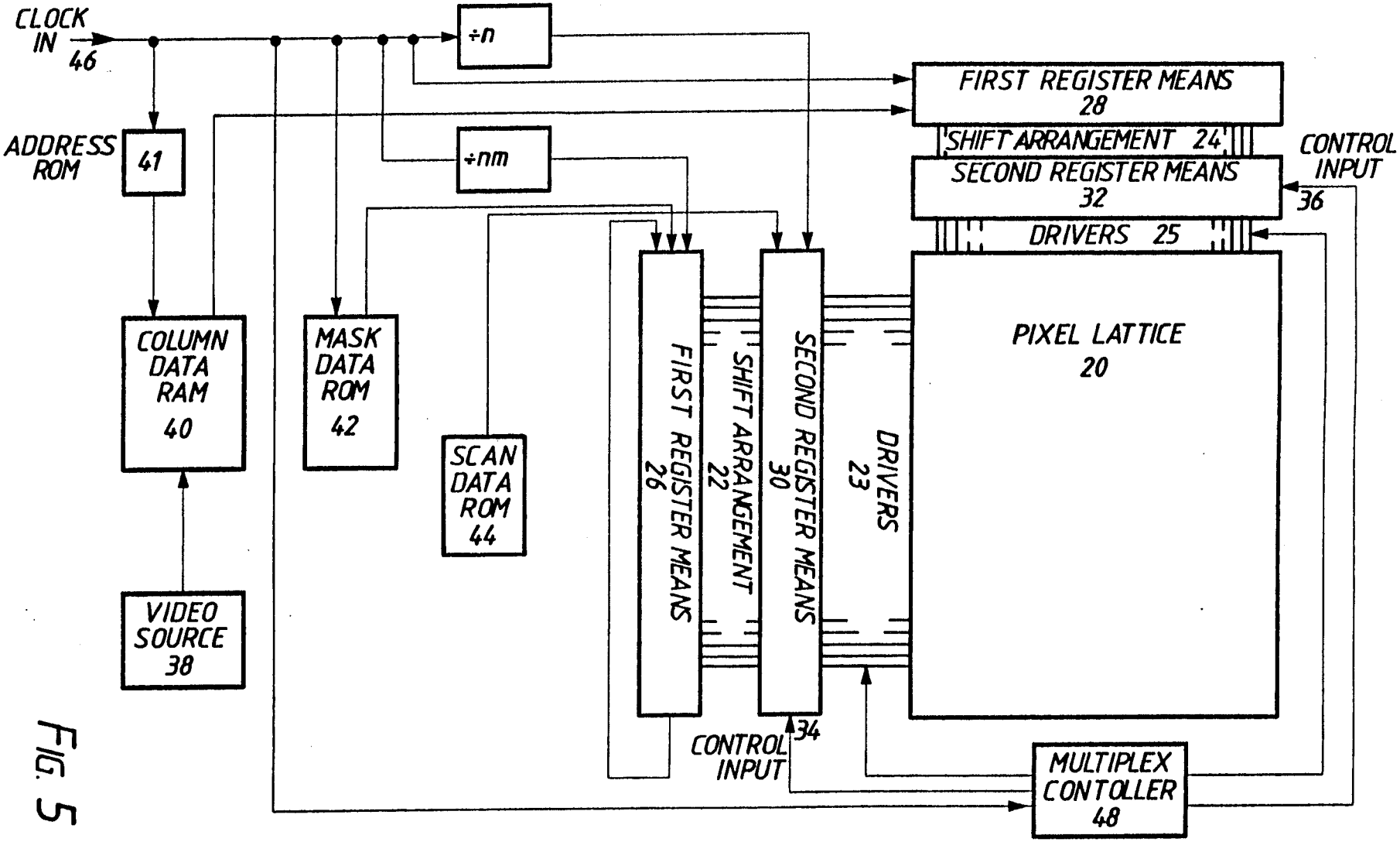

and FIG. 5 shows a block circuit diagram of a display device incorporating a versatile shift register arrangement and provided in accordance with the present invention.

Figure 1:
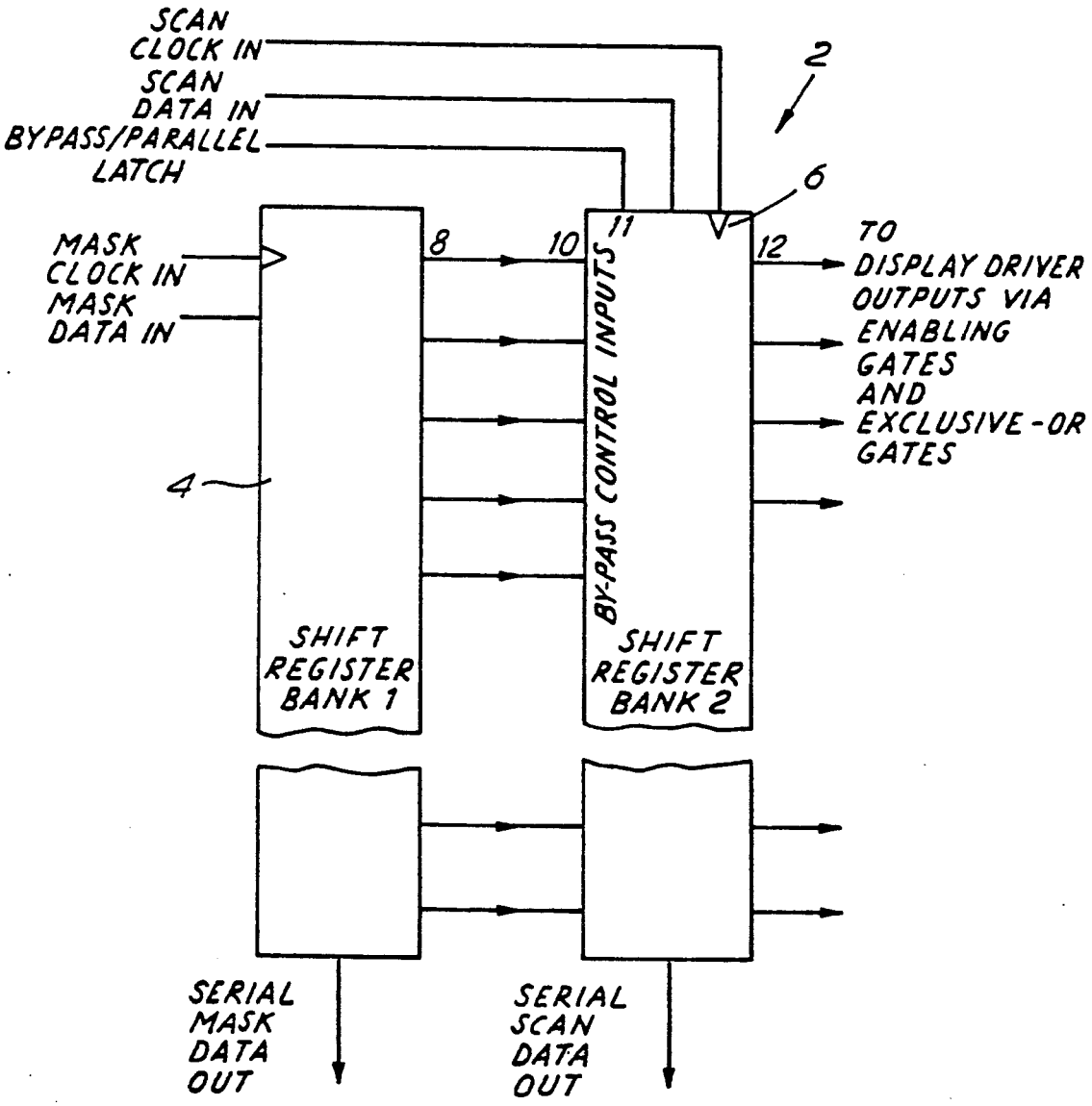
FIG. 1 shows a versatile shift register arrangement embodying the present invention.

FIG. 1 shows a versatile shift register arrangement 2 comprising a first register means 4 and a second register means 6, each register means 4, 6 being a bank of one or more registers. Each register means has a plurality of stages, an output of a first stage 8 in the first register means 4 being connected to an input 10 of a corresponding stage in the second register means 6 so as to designate operation of the corresponding stage.

Each of the registers that makes up the second register means 6 has a control input 11 that selects the function that the stages in that register are to perform. If this control input is held low then the register stages are cleared and the output of each register stage follows its input, i.e. the stages of the second register means are effective as transparent latches allowing information present in a stage of the first register means 4 to be present at an output 12 of a corresponding stage in the second register means 6. If this control input 11 is held high, then that register is caused to be in bypass mode, i.e. information present in a stage of the first register means 4 determines whether or not the corresponding stage in the second register means 6 is bypassed or can be enabled.

Figures 2, 4:
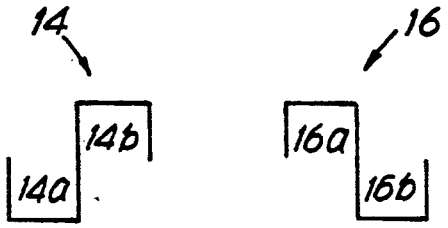
FIGS. 2 and 3 are representations of addressing schemes which can be implemented by the arrangement of FIG. 1.
FIG. 4 shows typical column waveforms used in a matrix-array type addressing scheme.

FIG. 2 shows how a non-sequential group addressing scheme can be implemented readily using this arrangement when the second register means 6 is in the bypass mode. The first column indicates the position of collections of pixel elements and the associated register stages of the first register means 4 and second register means 6. The second set of columns indicates the information present in the register stages of the first register means 4 at times $t_1$ and $t_5$. The third set of columns indicates the output of the corresponding stages of the second register means at times $t_1$ to $t_8$.

In the FIG. 2 example, the group of collections to be addressed in any addressing step consists of four members. The position of each member of the group for time $t_1$ is loaded into the appropriate stages of the first register means as bits '1', the other stages in the first register means being loaded with bits '0'. The strobe select bit is clocked along the second register means. If the input to a stage of a second register means from the respective stage of the first register means is low, i.e. contains a bit '0', then that stage is bypassed. If the input to a stage of a second register means from the respective stage of the first register means is high, i.e. contains a bit '1', then that stage is enabled and the corresponding collection of pixel elements is strobed. Thus, at time $t_1$, collection 1 is strobed and at time $t_2$, collection 2 is strobed. At time $t_3$, the strobe bit would be clocked to strobe collection 3 but this stage in the second register means has been bypassed as the respective stage in the first register means contains a '0'. Accordingly, the strobe bit is passed to the next stage in the second register means which has not been bypassed. This stage is 4 so collection 4 is strobed at time $t_3$. Similarity at time $t_4$, collection 8 is strobed. After time $t_4$, all the members of the group have been strobed and so a single clock pulse to the first register means moves the positions of the whole group along by one position, and the addressing continues. Thus, the order in which the collections is addressed is 1, 2, 4, 8, 2, 3, 5, 9 etc. The first register means is effective as a mask to specify which of the stages in the second register means should be bypassed.

The only limitation of this system is the propagation delay between subsequent enabled registers. Assuming 10 nS propagation delay between each register in bypass mode then 1000 register skips can be coped with when the row address time is as low as 10 μS.

Figure 3:
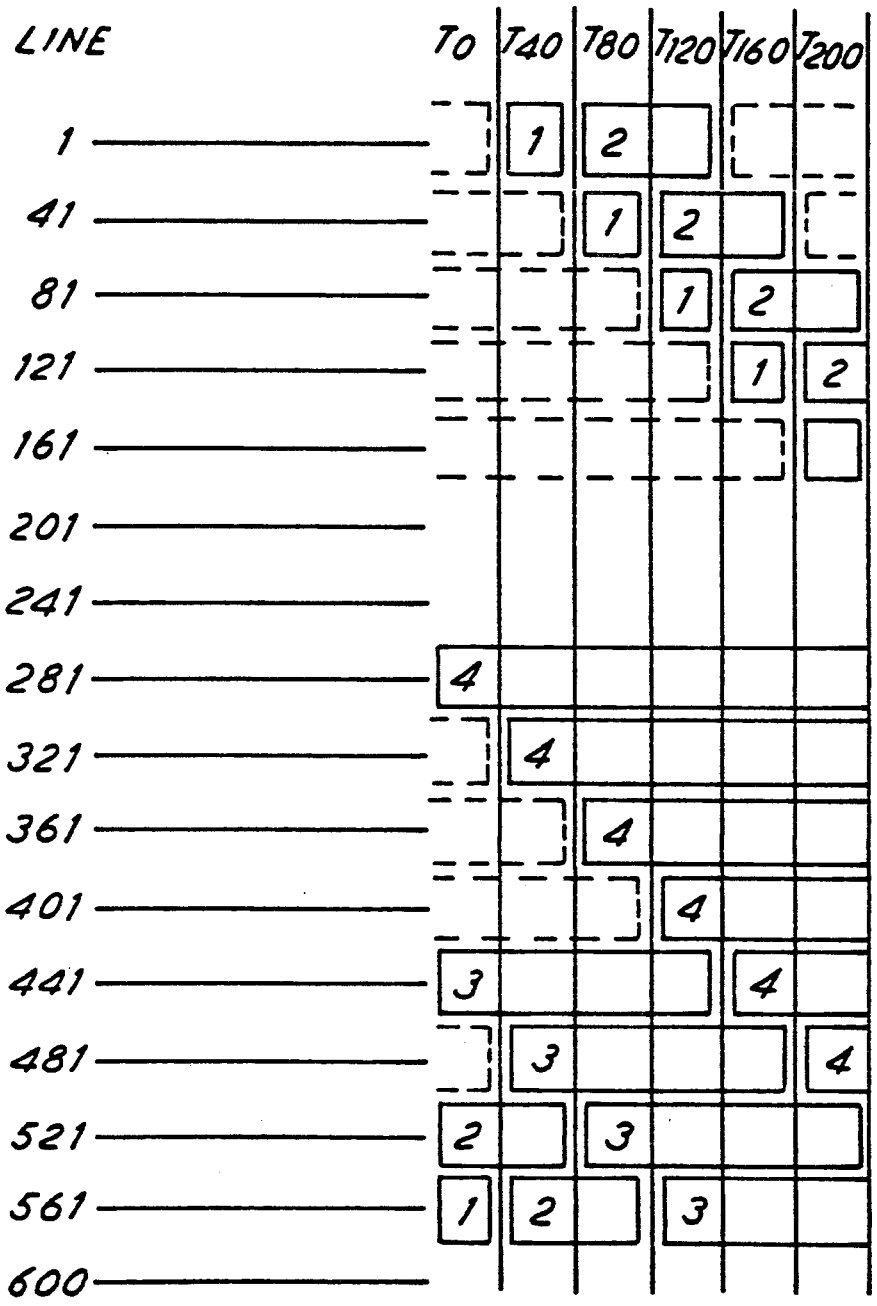

Considering now the addressing sequence shown in FIG. 3, the first register contains 4 bits, in stages 281, 441, 521 and 561, all the other stages containing an 0, each stage which contains an 0 causing the corresponding stage of the second register to be by-passed. Assuming the bit in the first register has just been shifted into stage 281, the output of the latter causes collection 281 to be strobed and written. The next clock pulse shifts the bit to stage 441 since all the intervening stages are by-passed. After collection 441 has been written the bit is shifted in the same way to stages 521 then 561. After all four collections of the group have been written (within 1 line period) the next clock pulse shifts the bit out of stage 561. After a short delay, the first register is clocked to shift its bits to stages 282, 442, 522 and 562 respectively. This takes place while the bit in the second register is propagating and it will therefore be shifted into stage 282. The by-passed register acts as though it has zero on its input, so any delay is not critical. The register is not connected in a loop so stage 282 gets data originating externally.

As outlined hereinbefore control input to the integrated circuit incorporating these shift registers can be used to select the function of the second bank of registers between that of the bypass mode and that of a set of parallel loading transparent latches. When configured as transparent latches the integrated circuits would be ideal for use as column drivers, loading image data in serially and applying it to the columns in parallel.

The outputs of the stages in the second register means are connected to the inputs of exclusive-or (XOR) gates, which is particularly advantageous for arrangements 2 used as column drivers. The truth table for an XOR gate is shown below.

| Input 1 | Input 2 | Output |
|---|---|---|
| 0 | 0 | 0 |
| 0 | 1 | 1 |
| 1 | 0 | 1 |

-continued

| Input 1 | Input 2 | Output |
|---|---|---|
| 1 | 1 | 0 |

In an addressing method in which collections or rows of pixel elements are strobed, the waveform applied to a column determines whether or not the pixel at the intersection of the strobed collection and that column is 'on' or 'off'. FIG. 4 shows an examle of a column 'on' and a corresponding column 'off' waveform. As can be seen, each waveform 14, 16 can be divided into subwaveforms 14*a*, 14*b*; 16*a*, 16*b* of the same shape but a different polarity. Thus, if a negative polarity subwaveform 14*a*, 16*b* is produced by a stage with a '0' output and a positive polarity subwaveform 14*b*, 16*a* is produced by a stage with a '1' output, it is possible to generate the required waveforms at the column drivers by loading in a '0' or a '1' at the appropriate register stage to generate the subwaveform of the correct polarity. The output of the register stage is connected to the input of an XOR gate whose other input is held at 0 and so the output of the XOR gate follows the input. The other subwaveform can then simply be generated by changing the other input of the XOR gate to '1'.

FIG. 5 shows a display device with a lattice of pixel elements (indicated generally at 20) and a first versatile shift arrangement 22 for selecting the addressing of the rows via a plurality 23 of drivers and XOR gates and a second versatile shift arrangement 24 for selecting the addressing of the columns via a plurality 25 of drivers and XOR gates. Each versatile shift arrangement 22, 24 comprises first register means 26, 28 and second register means 30, 32. A control input 34 to the second register means 30 for addressing the rows is held high so that this register means 30 is in bypass mode. A control input 36 to the second register means 32 for addressing the columns is held low so that this register means 32 is effective as a set of transparent latches.

A signal is received from a video source 38 corresponding to one picture in length and stored in a column data RAM 40. The order in which the pixels are to be written is determined by an address ROM 41. A mask data ROM 42 determines the position of the members of a group to be addressed in a non-sequential group addressing scheme. This information is loaded serially into the first shift register means 26 of the row versatile shift arrangement 22. A strobe bit from a scan data ROM 44 is loaded into the second shift register means, its position determining which of the rows or collections of rows is to be strobed as outlined hereinbefore.

When clock pulses of frequency f from a source 46 are applied to the column data RAM 40 via the address ROM 41, data for pixels of the next row to be strobed is loaded serially into the first shift register means 28 of the column versatile shift arrangement 24 and hence is present at the output of the register stages of the second shift register means 32. Accordingly if the number of pixels in a row is n, then a clock pulse of frequency f/n is applied to the second shift register means 30 of the row versatile shift arrangement 22 to clock the strobe bit and a clock pulse of frequency f/nm is applied to the first shift register means 26 tomove the positions of the members of the group along by one (The value of m is determined by the particular non-sequential group addressing scheme used). A multiplex controller 48 controls the waveforms to be produced by the column drivers and XOR gates 23, 25 in response to the data loaded into the versatile shift arrangements 22, 24.

Such a display device as shown in FIG. 5 can be addressed by the non-sequential group addressing schemes disclosed in our copending published European Patent Application No. 0261901A and our copending European Patent Applications claiming priority from GB 8728433 and from GB 8728434.

Modifications to the embidiments described and within the scope of the present invention will be apparent to those skilled in the art.

I claim:

1. Apparatus for time-multiplex addressing a display device having an array of collections of pixel elements, the apparatus comprising;

interconnected first and second register means adapted to receive data for addressing the array; the first register means having a plurality of inputs to receive the data and a plurality of outputs connected to a corresponding plurality of inputs of the second register means, which second register means may function in either a first or second mode, the first mode permitting unaffected throughput of the data received via the first register means, and the second mode effective to enable or bypass the operation of the second register means in dependence upon the data received from the outputs of the first register means;

the second register means adapted to receive control signals thereby to determine the function of the second register means in dependence upon the control signals, hence to provide data for addressing the array.

2. Apparatus according to claim 1 wherein the first register means comprises a plurality of first stages and the second register means comprises a plurality of corresponding stages.

3. Apparatus according to claim 1 wherein the first and second register means comprise shift register means.

4. Apparatus according to claim 2 wherein the first and second register means comprise shift register means.

5. A method of addressing a display device having an array of collections of pixel elements, the method comprising;

time-multiplex addressing collections of pixels with data via interconnected first and second register means, the first register means having a plurality of inputs to receive the data and a plurality of outputs connected to a corresponding plurality of inputs of the second register means, which second register means may function in either a first or second mode, the first mode permitting unaffected throughput of the data received via the first register means, and the second mode effective to enable or bypass the operation of the second register means in dependence upon data received from the outputs of the first register means;

the method further comprising supplying control signals to the second register means thereby to determine the function performed by the second register means on data supplied thereto via the first register means in dependence upon the control signals, hence to provide data for addressing the array.

6. A method according to claim 5 wherein the first register means comprises a plurality of first stages and the second register means comprises a plurality of corresponding stages.

7. A method according to claim 6 wherein the addressing includes addressing a plurality of non-sequential collections of pixel elements, and wherein the position of each of the plurality of non-sequential collections is input into a respective first stage in the first register means, each said first stage adapted to enable the corresponding stage in the second register means.

* * * * *